United States Patent [19]

Ohtsuka et al.

[11] Patent Number: 4,851,877

[45] Date of Patent: Jul. 25, 1989

[54] PROCESSING HEAD WITH RINSING LIQUID SUPPLY FOR ELECTROPHOTOGRAPHIC APPARATUS

[75] Inventors: Shuichi Ohtsuka; Akira Yoda, both of Kanagawa, Japan

[73] Assignee: Fuji Photo Film Co., Ltd., Kanagawa, Japan

[21] Appl. No.: 148,322

[22] Filed: Jan. 25, 1988

[30] Foreign Application Priority Data

Jan. 23, 1987 [JP] Japan ..... 62-13625

[51] Int. Cl.[4] ..... G03G 15/10

[52] U.S. Cl. ..... 355/256; 118/652; 118/659; 355/264

[58] Field of Search ..... 355/10, 3 R, 27, 54, 355/15; 118/659–662, 652

[56] References Cited

U.S. PATENT DOCUMENTS 4,760,425 7/1988 Okano et al. ..... 355/10

4,767,689 8/1988 Bibl et al. ..... 355/10 X

*Primary Examiner*—A. T. Grimley

*Assistant Examiner*—J. Pendegrass

*Attorney, Agent, or Firm*—Sughrue, Mion, Zinn, Macpeak & Seas

[57] ABSTRACT

A process head for an electrophotographic apparatus is adapted to charge an electrophotographic film, expose the thus charged film to image light so as to form an image on the film, develop the thus formed image by means of a liquid developer in a developing section, and dry the film then fix the thus developed image. The processing head is capable of supplying a rinsing liquid to the developing section after the completion of the developing. Therefore, any liquid developer adhering to the developing section can be removed.

15 Claims, 18 Drawing Sheets

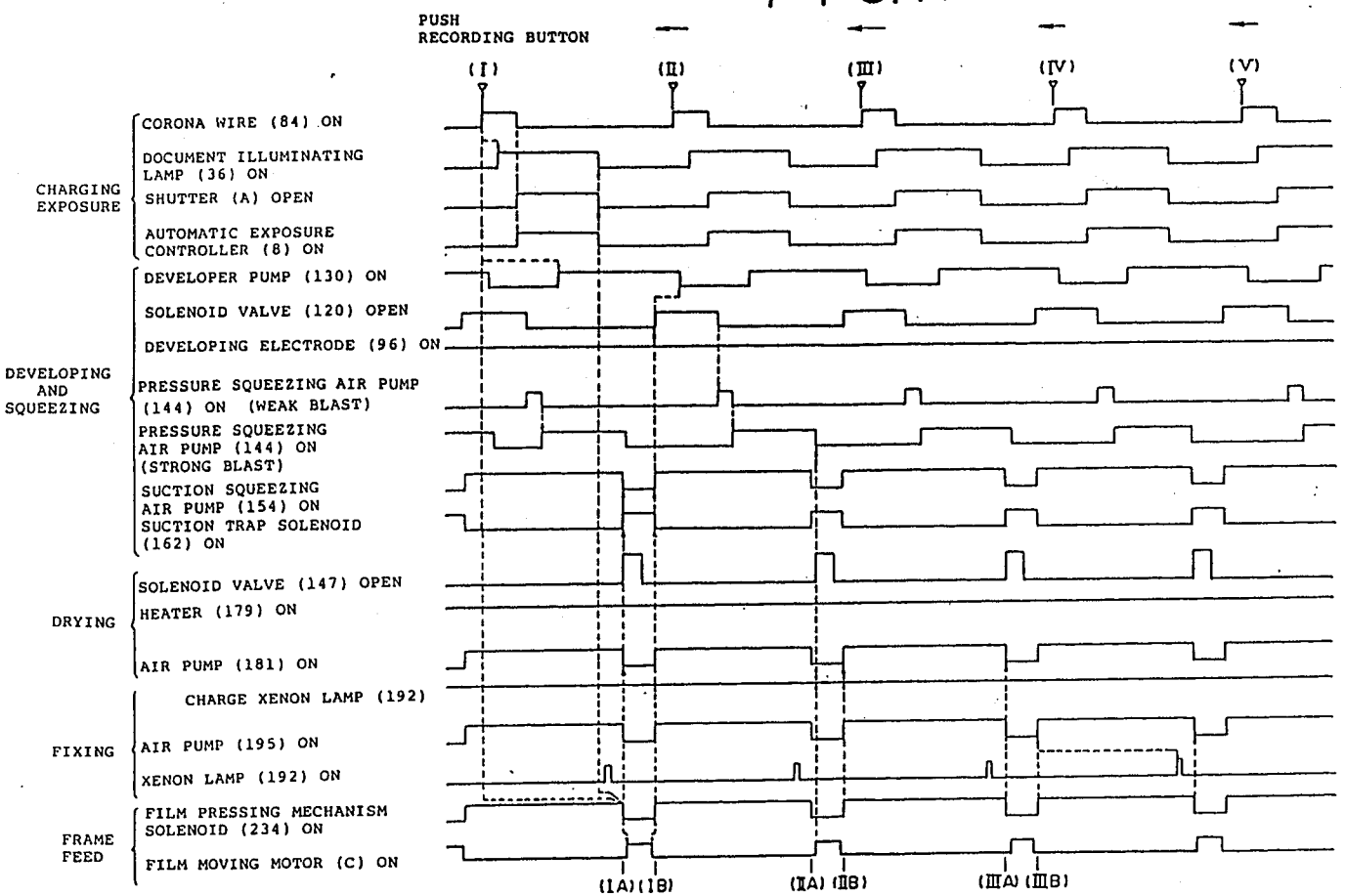
FIG.17
PUSH RECORDING BUTTON
(I)
(II)
(III)
(IV)
(V)
(IA)(IB)
(IIA)(IIB)
(IIIA)(IIIB)
CHARGING EXPOSURE
CORONA WIRE (84) ON
DOCUMENT ILLUMINATING LAMP (36) ON
SHUTTER (A) OPEN
AUTOMATIC EXPOSURE CONTROLLER (8) ON
DEVELOPER PUMP (130) ON
SOLENOID VALVE (120) OPEN
DEVELOPING ELECTRODE (96) ON
DEVELOPING AND SQUEEZING
PRESSURE SQUEEZING AIR PUMP (144) ON (WEAK BLAST)
PRESSURE SQUEEZING AIR PUMP (144) ON (STRONG BLAST)
SUCTION SQUEEZING AIR PUMP (154) ON
SUCTION TRAP SOLENOID (162) ON
DRYING
SOLENOID VALVE (147) OPEN
HEATER (179) ON
AIR PUMP (181) ON
FIXING
CHARGE XENON LAMP (192)
AIR PUMP (195) ON
XENON LAMP (192) ON
FRAME FEED
FILM PRESSING MECHANISM SOLENOID (234) ON
FILM MOVING MOTOR (C) ON

PROCESSING HEAD WITH RINSING LIQUID SUPPLY FOR ELECTROPHOTOGRAPHIC APPARATUS

BACKGROUND OF THE INVENTION

1. Field of the Invention

The present invention relates to a processing head incorporated in an electrophotographic apparatus for executing various kinds of processing of electrophotographic films.

2. Description of the Prior Art

One type of photographic apparatus has heretofore been known which is capable of recording an image on a predetermined frame of a photographic film and of projecting or copying the recorded image.

A processing head is disposed in such photographic apparatus to subject an electrophotographic film to various kinds of processing such as charging/exposure and development, and such a processing head is known from the specifications of U.S. Pat. Nos. 4,591,543, 4,600,291, 4,613,226 4,623,240, 4,671,648 and so forth.

The processing head disclosed in the above-mentioned specifications has a charging exposure section, a developing section, a drying section, and a fixing section. These sections are disposed side by side in the mentioned order in the direction in which an electrophotographic film is fed at a constant pitch which corresponds to the pitch of frames of the electrophotographic film.

In the charging exposure section, a portion of the electrophotographic film (corresponding to one frame of the film) which is positioned at this section is charged and is then exposed to light reflected from a document carrying an image. By this operation, an electrostatic latent image which corresponds to the image pattern on the document is formed on the frame of the electrophotographic film. In the developing section, the frame of film which has been subjected to exposure in the charging exposure section is coated with a liquid developer so as to make the electrostatic latent image visible. In the image section, dry air is applied to the frame of film which is wet from the liquid developer so as to remove moisture therefrom. In the fixing section, the image is fixed on the frame of film by means of a fixing lamp or the like.

With this processing head, part of the liquid developer coated on the electrophotographic film after the film has been charged and exposed may remain in the developing section, particularly on a developing electrode thereof, and adhere thereto as surplus developer after the completion of the developing. In order to remove the surplus developer, the processing head is adapted to use air to swish off the surplus developer.

However, there is a fear that some of the surplus developer may not be removed and may, instead, dry and become solidified. The amount of surplus developer adhering to and being deposited on the developing electrode will increase as the number of times development is performed increases. When the amount of the surplus developer adhering to and deposited on the developing electrode in this way exceeds a certain level, some of the surplus developer may become partially exfoliated and turned away from the electrode, projecting toward the space between the electrophotographic film and the electrode, that is, into the developing chamber. The solidified developer which projects in this way may disturb the flow of developer which will flow in the developing chamber during the developing of subsequent frames, causing non-uniform flow of the developer. This may result in the formation of defective images.

SUMMARY OF THE INVENTION

In view of the above-described circumstances, it is a primary object of the present invention to provide a processing head for an electrophotographic apparatus which is capable of eliminating the risk that solidified surplus developer which adheres to the developing electrode may be deposited thereon and exfoliated therefrom to present an obstacle to the flow of developer, and which is thus capable of ensuring that the flow of developer is uniform.

To this end, the present invention provides a processing head for an electrophotographic apparatus which is adapted to press an electrophotographic film against a processing head body so as to charge and expose the film for the formation of an image thereon, develop the image thus formed on the film by supplying a developer to a developing section having a developing electrode, and dry the film and fix the image thus developed. The processing head in accordance with the present invention is characterized by comprising rinsing liquid supply means for supplying a rinsing liquid to the developing section after the completion of the developing.

With the processing head in accordance with the present invention, the rinsing liquid supply means supplies a rinsing liquid to the developing section when the developing has been completed, so that any surplus developer adhering to the developing electrode is removed therefrom and is then rinsed away. By virtue of this arrangement, it is possible to eliminate the risk that any surplus developer which adheres to the developing electrode may be deposited thereon and may be partially exfoliated and project into the developing chamber, thereby eliminating the risk of the surplus developer presenting an obstacle to the flow of developer. In this way, it is ensured that the flow of the developer is uniform.

BRIEF DESCRIPTION OF THE DRAWINGS

FIG. 17 is a time chart showing various operations of the electrophotographic apparatus in the camera mode.

DESCRIPTION OF THE PREFERRED EMBODIMENT

The present invention will be described hereinunder in detail with reference to the accompanying drawings.

Figure 1:
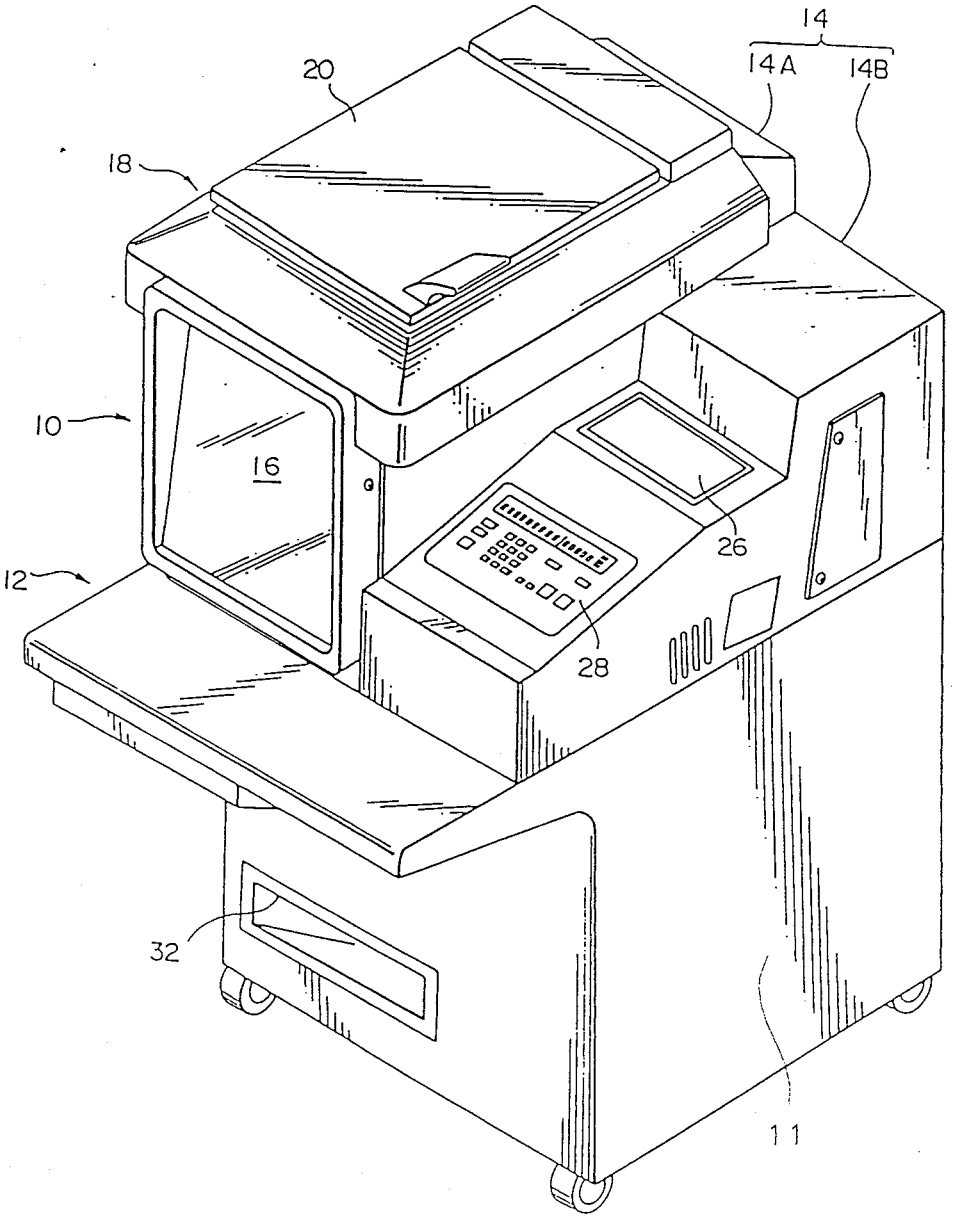
FIG. 1 is a perspective view showing the external appearance of one example of an electrophotographic apparatus.

FIG. 1 shows one example of an electrophotographic apparatus in which a processing head in accordance with one embodiment of the present invention is disposed. The electrophotographic apparatus has various functions: namely, the camera function which enables the image of a document to be recorded on an electrophotographic microfilm; the reader function which enables the image recorded on the film to be enlarged and projected on a screen; and the copy function which enables the image recorded on the film to be enlarged and copied on a sheet of copying paper.

The electrophotographic apparatus has an integral structure which consists of an electrophotographic apparatus body 10, a housing 11, and a copying machine 12 serving also as a table for mounting the body 10. When the copy function is not needed, the electrophotographic apparatus body 10 may be used alone. The apparatus body 10 includes a housing 14 which consists of a left-hand portion 14A having a substantially rectangular parallelepiped configuration and a right-hand portion 14B which has a stepped upper surface. The respective internal spaces of these portions 14A and 14B are communicated with each other at the side thereof which is closer to the rear end of the apparatus.

A rear projection screen 16 is disposed in the housing portion 14A in such a manner that the screen 16 closes an opening provided in the front side of the housing portion 14A and it is slightly slanted rearwardly. A document table 18 is disposed on the upper side of the housing portion 14A. The document table 18 includes a document pressing plate 20 which can be opened and closed as desired, and a transparent glass plate 22 (see FIG. 2) which is disposed underneath the plate in such a manner as to close an opening provided in the upper side of the housing portion 14A. A cassette loading section 26 into which a cassette accommodating an electrophotographic microfilm 24 (see FIG. 2; hereinafter referred to as an "electrophotographic film") can be loaded is provided in the central portion of the upper side of the housing portion 14B. A control keyboard 28 through which various controls of the electrophotographic apparatus are effected is disposed on the front portion of the upper side of the housing portion 14B.

Figure 4:
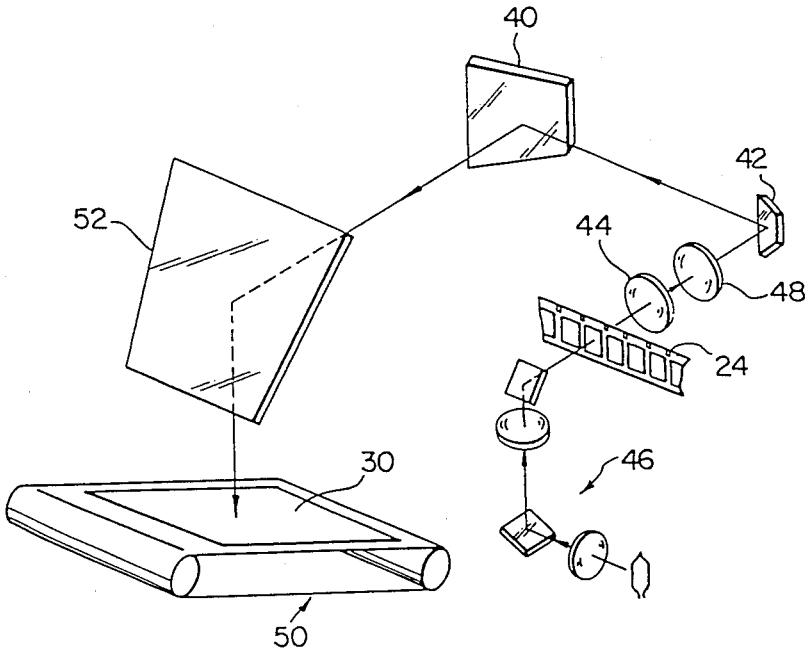
FIG. 4 is a schematic perspective view of a copying optical system in the electrophotographic apparatus.

The housing 11 of the copying machine 12 is provided with an opening 32 for delivering a copied sheet of paper 32 (see FIG. 4).

Optical Systems of Electrophotographic Apparatus

Figure 2:
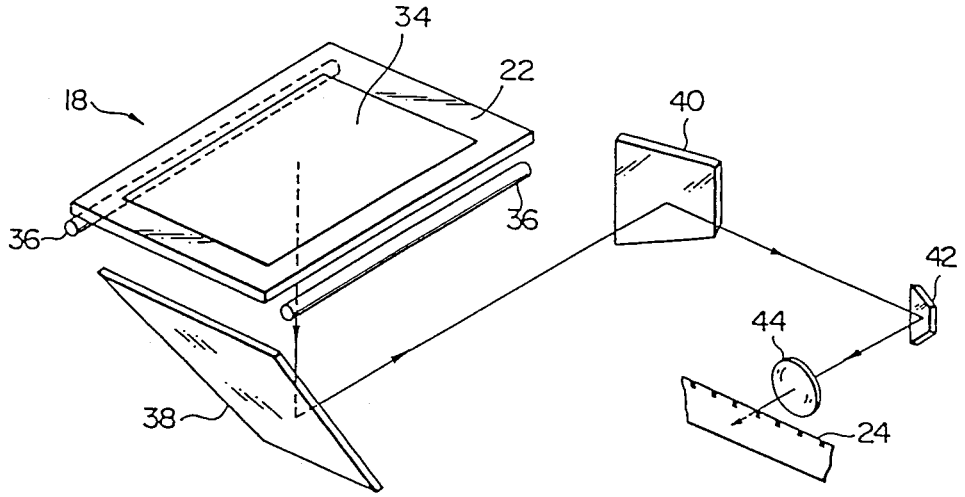
FIG. 2 is a schematic perspective view of a recording optical system in the electrophotographic apparatus.

FIGS. 2 and 4 show various optical systems of the electrophotographic apparatus.

Referring first to FIG. 2, the recording optical system includes a document illuminating lamp 36 which illuminates a document 34 as a subject which is set on the glass plate 22 of the document table 18 in such a manner that the document surface faces downward, a third mirror 38 on which the light reflected from the document 34 is made incident, a second mirror 40 on which the light reflected from the third mirror 38 is made incident, a first mirror 42 on which the light reflected from the second mirror 40 is made incident, and a main lens 44 for focusing the light reflected from the first mirror 42 on the surface of an electrophotographic film 24.

Figure 3:
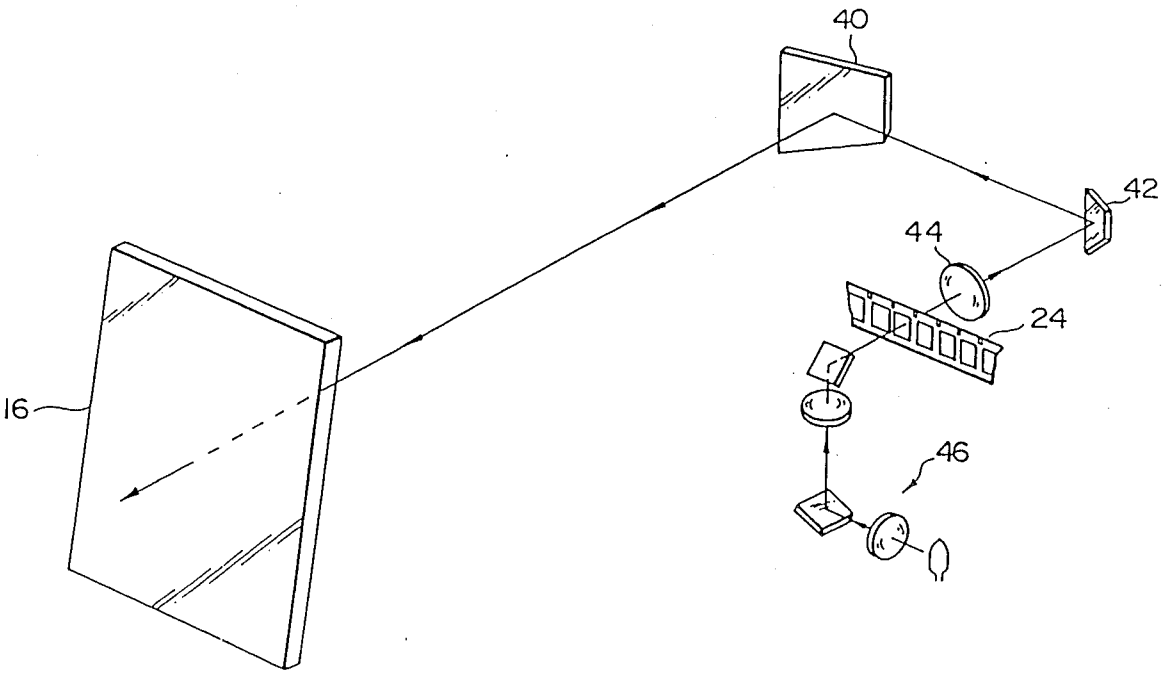
FIG. 3 is a schematic perspective view of a projecting optical system in the electrophotographic apparatus.

Referring next to FIG. 3, the projecting optical system includes a projecting light source section 46 for irradiating the electrophotographic film 24, the main lens 44 for focusing the light passing through the film 24 on the first mirror 42, the second mirror 40 on which the light reflected from the first mirror 42 is made incident, and the screen 16 on which the light reflected from the second mirror 40 is projected.

As shown in FIG. 4, the copying optical system includes the projecting light source section 46, the main lens 44, the first mirror 42, the second mirror 40, a conversion lens 48 disposed between the main lens 44 and the first mirror 42 to slightly reduce the optical image formed on the first mirror, and a copy mirror 52 adapted to reflect the light reflected from the second mirror 40 toward a sheet of copying paper 30 set on an exposing table 50 disposed in the copying machine 12.

The main lens 44 and the first and second mirrors 42, 40 are mutually used for the above-described three optical systems. The main lens 44 and the first mirror 42 are fixedly disposed within the housing portion 148 of the electrophotographic apparatus body 10, while the second mirror 40 is fixedly disposed within the housing portion 14A.

The third mirror 38, the copy mirror 52, the conversion lens 48 and the screen 16 are selectively used. The third mirror 38 and the copy mirror 52 are movably disposed within the housing portion 14A of the apparatus body 10, while the conversion lens 48 is movably disposed within the housing portion 14B so that the lens 48 is prevented from interfering with any other optical systems. Since the screen 16 does not interfere with any other optical systems, it is fixedly disposed as described above.

In addition, a shutter (not shown) which is controlled by an automatic exposure controller is disposed between the main lens 44 and the first mirror 42 in the optical systems of the electrophotographic apparatus.

Processing Head

FIGS. 5 to 14 show in combination the processing head in accordance with one embodiment of the present invention which is disposed in the above-described electrophotographic apparatus.

Figure 5:
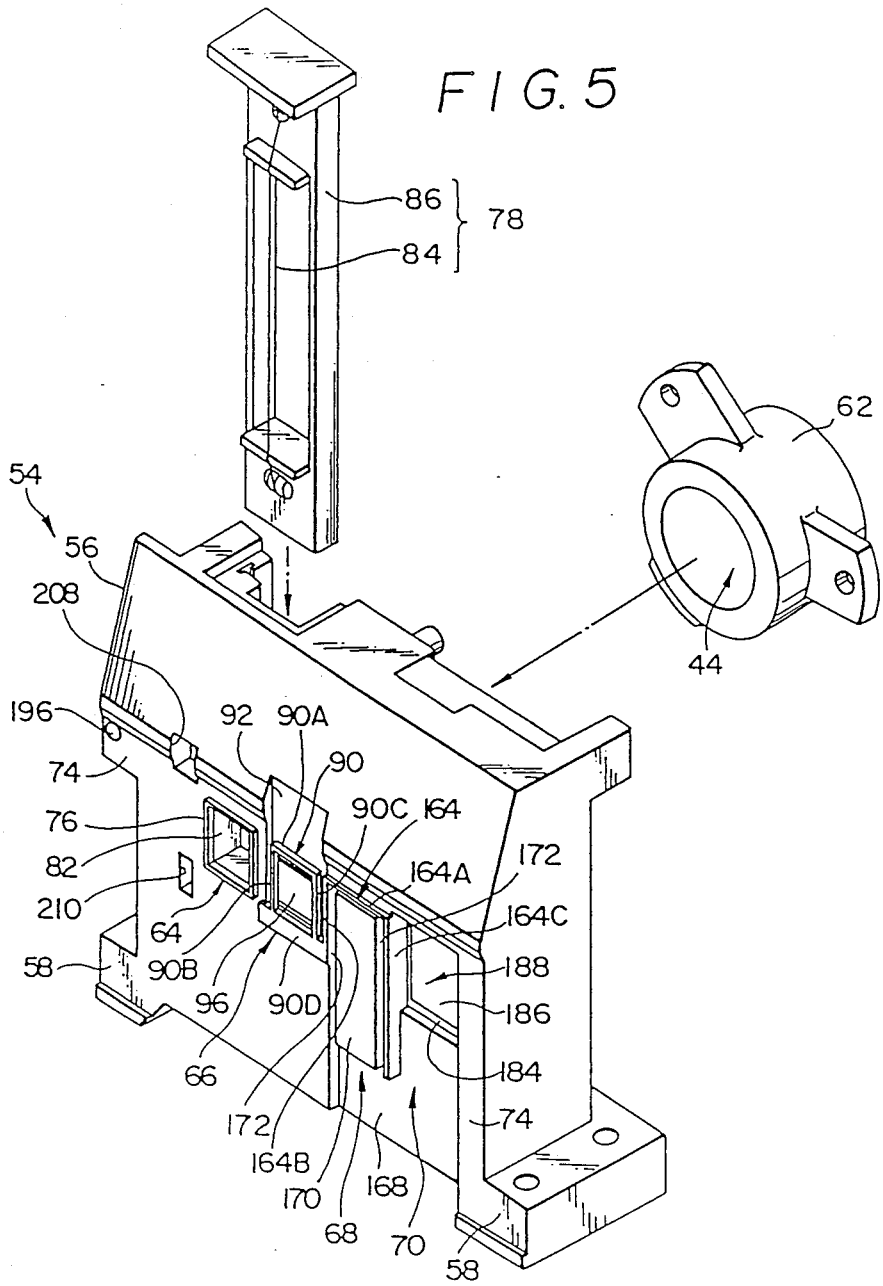
FIG. 5 is an exploded perspective view of a processing head in accordance with one embodiment of the present invention which is disposed in the electrophotographic apparatus in FIG. 1.
Figure 6:
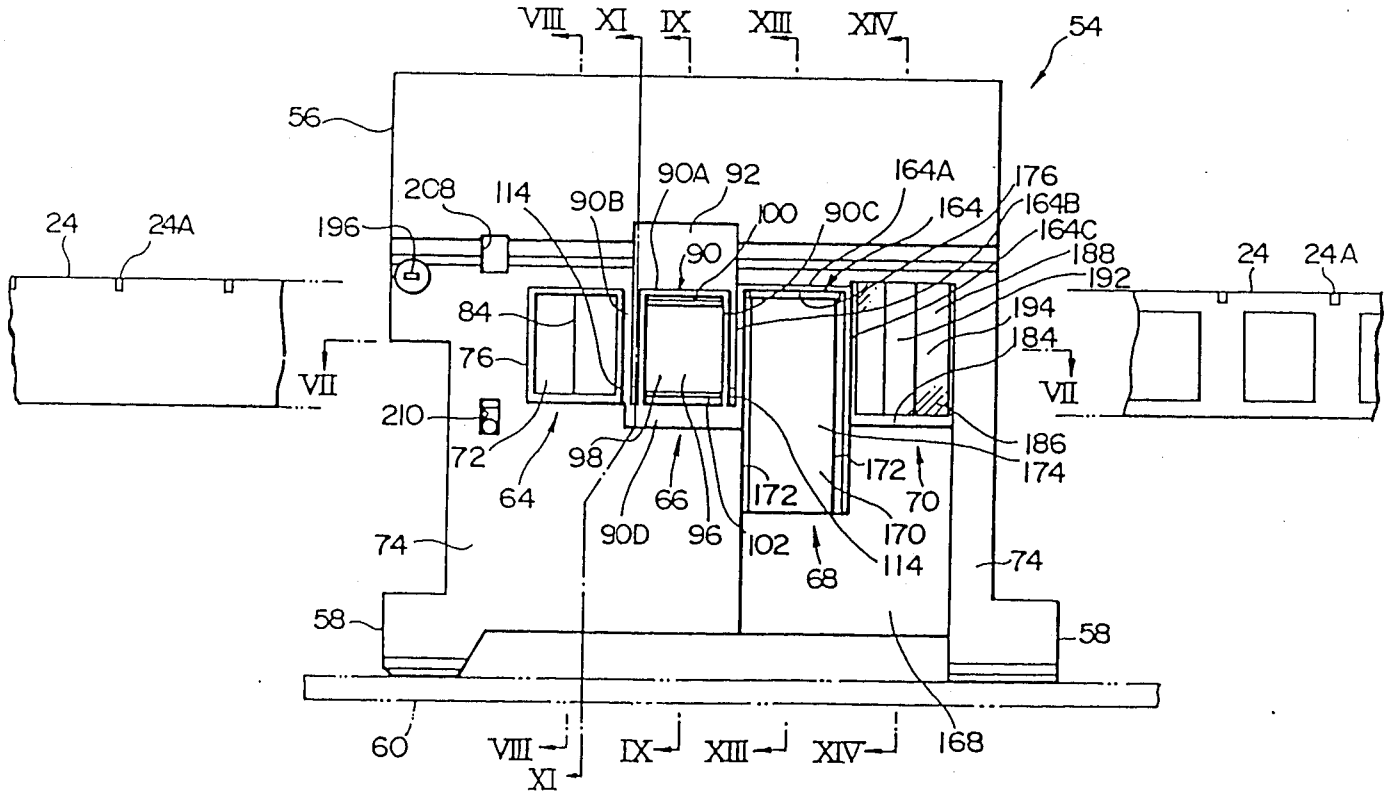
FIG. 6 is a front view of the processing head.

Referring first to FIGS. 5 and 6, the processing head 54 has a integral structure which consists of a relatively flat body portion 56 having a substantially rectangular parallelepiped configuration, and a pair of leg portions 58 located below the body portion 56. The processing head 54 is formed of a synthetic resin by an integral molding process except for fitting members. The processing head 54 is disposed between the main lens 44 and the electrophotographic film 24, which are shown in FIGS. 2 to 4, and the leg portions 58 are secured to a frame 60 disposed within the housing portion 14B of the apparatus body 10, as shown in FIG. 6.

Figure 7:
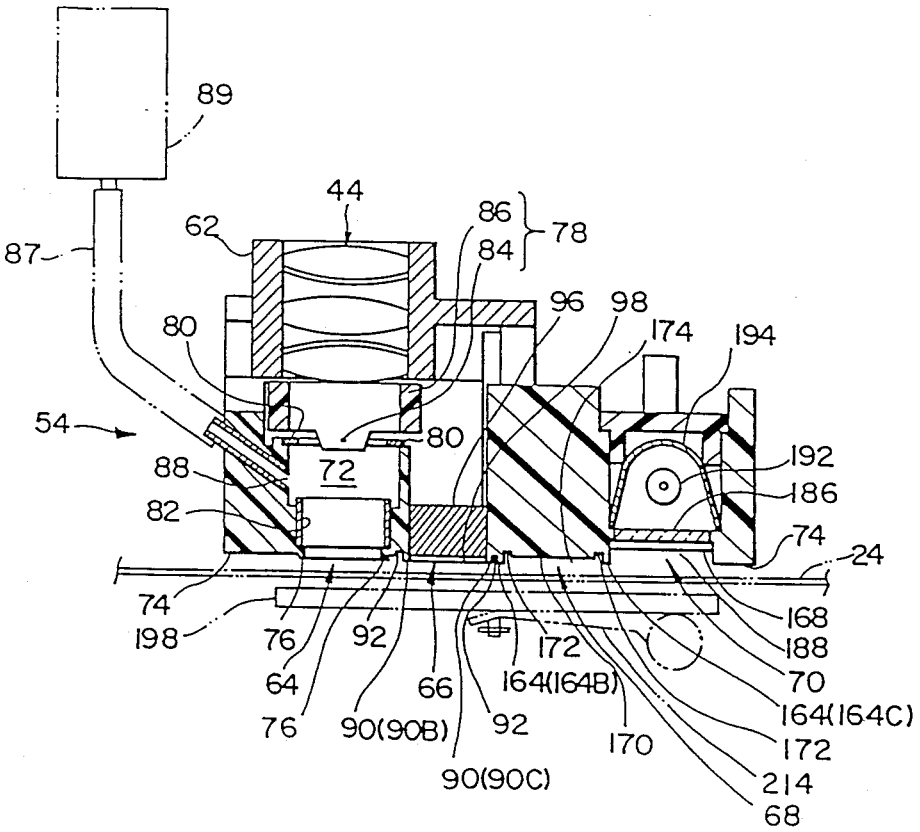
FIG. 7 is a sectional view taken along the line VII—VII shown in FIG. 6.

The main lens 44 is, as shown in FIGS. 5 and 7, fitted in a lens tube 62 which is, in turn, secured to the rear side of the processing head 54. The electrophotographic film 24 is formed by successively coating a transparent electrically conductive layer, an intermediate layer and a photosensitive layer on a carrier of, e.g., polyethylene. The photosensitive layer consists of a photoconductive layer and a protective layer for protecting the photoconductive layer. This electrophotographic film 24 is formed in the shape of a continuous tape and accommodated in a cassette casing.

Blip marks 24A are printed in advance on the upper edge (as viewed in FIG. 6) of the film 24 at a predetermined regular spacing in the longitudinal direction thereof. Each blip mark 24A is provided in correspondence with one frame for an image which is to be recorded on the film 24. The film 24 is disposed in such a manner that the photosensitive layer side thereof faces the front side of the processing head 54, and is movable in the lateral direction (i.e., the horizontal direction as viewed in FIG. 6) of the processing head 54 by driving a film moving motor (not shown). The transparent electrically conductive layer of the film 24 is adapted to provide electrical connection with the apparatus body 10 when the cassette is loaded therein. It is a matter of course that any type of known electrophotographic film may be employed in lieu of the film of the type described above.

As shown in FIGS. 5 to 7, a charging exposure section 64, a developing section 66, a drying section 68 and a fixing section 70 are successively formed in the body portion 56 of the processing head 54 along the lateral direction thereof at a constant pitch which corresponds to the frame pitch of the film 24.

Charging Exposure Section

Figure 8:
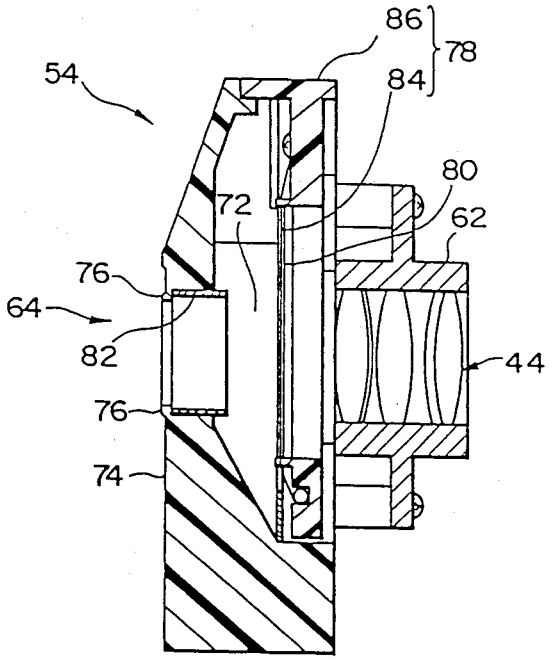
FIG. 8 is a sectional view taken along the line VIII—VIII shown in FIG. 6.

As shown in FIGS. 7 and 8, the charging exposure section 64 has a charging exposure chamber 72 which is defined by an internal space provided in the reverse side of a front wall 74 of the processing head 54. The chamber 72 is communicated with an opening provided in the front wall 74 of the head 54. As also shown in FIGS. 5 and 6, a mask 76 is formed along the peripheral edge of the opening in the front wall 74, the mask 76 slightly projecting from the surface of the front wall 74. The mask 76 defines a rectangular opening the size of which corresponds to one frame of the film 24. In the charging exposure chamber 72 are disposed a corona unit 78, proximity electrodes 80 and a mask electrode 82.

As shown in FIG. 5, the corona unit 78 consists of a corona wire 84 and a holder 86 made of a synthetic resin and adapted to hold the corona wire 84, the unit 78 being inserted into the processing head 54 from the upper side thereof. The proximity electrodes 80 are respectively defined by relatively narrow metal plates and disposed on both sides of the corona wire 84. The mask electrode 82 is formed by bending a metal plate in a square shape, and is disposed in the vicinity of the opening in the front wall 74. The corona wire 84 is connected to a high-voltage power supply, while the proximity electrodes 80 and the mask electrode 82 are electrically connected to each other. In general, the proximity electrodes 80 are connected directly to the ground, while the mask electrode 82 is connected to the ground through an electrical resistance. However, bias voltages which are different from each other may be respectively applied to the proximity and mask electrodes 80 and 82 from an external power supply.

As shown in FIG. 7, a film cooling air inlet 88 is opened into the charging exposure chamber 72 so that cold air is supplied to the chamber 72 with an air pump 89 through a pipe 87. The main lens 44, which is mounted on the rear side of the processing head 54 through the lens tube 62, as described before, has the optical axis thereof made coincident with the center of the opening defined by the mask 76.

Developing Section

As shown in FIGS. 5 and 6, the developing section 66 has a mask 90. The mask 90 is defined by an upper frame member 90A, left and right frame members 90B, 90C, and a lower frame member 90D. The upper frame member 90A and the left and right frame members 90B and 90C rise from the surface of a recess 92 formed in the front wall 74, and the lower frame member 90D rises from the front wall 74. Both longitudinal end portions of the lower frame member 90D project horizontally from the joints between the frame member 90D and the left and right frame members 90B and 90C. The amount by which the mask 90 projects is set to that the mask is flush with the mask 76.

The width of the opening defined by the mask 90 is set such as to be slightly smaller than that of the opening defined by the mask 76. The height of the opening defined by the mask 90, that is, the distance between the respective inner walls of the upper and lower frame members 90A and 90D, is set such as to be larger than that of the opening defined by the mask 76 since the inner wall of the lower frame member 90D is positioned lower than that of the mask 76.

Figure 9:
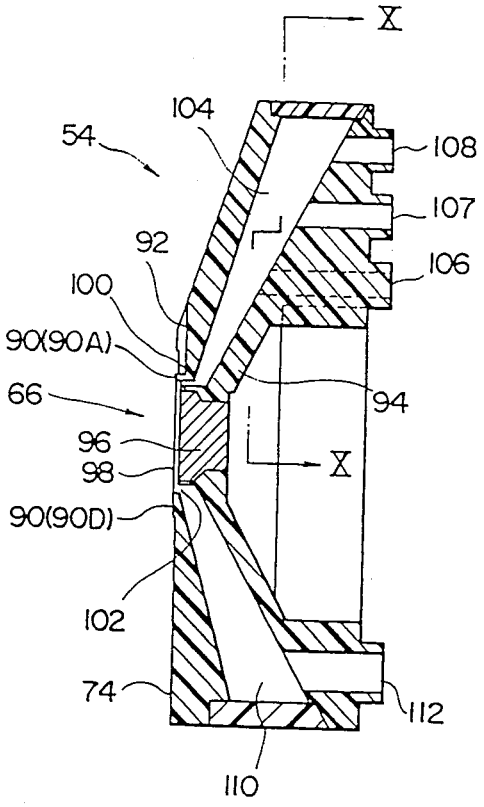
FIG. 9 is a sectional view taken along the line IX—IX shown in FIG. 6.

As shown in FIG. 9, a developing electrode 96 is disposed within the opening defined by the mask 90, the electrode 96 being supported by a rear wall 94. The developing electrode 96 is connected to a bias power supply. The electrode 96 is positioned in such a manner that the outer surface thereof is located at a position which is slightly recessed from the end face of the mask 90. The space surrounded by the developing electrode 96 and the inner walls of the mask 90 defines a developing chamber 98. An opening is provided between the upper edge of the electrode 96 and the mask 90 to define a developer and squeezing air inlet 100, and another opening is provided between the lower edge of the electrode 96 and the mask 90 to define a developer and squeezing air outlet 102.

Figure 10:
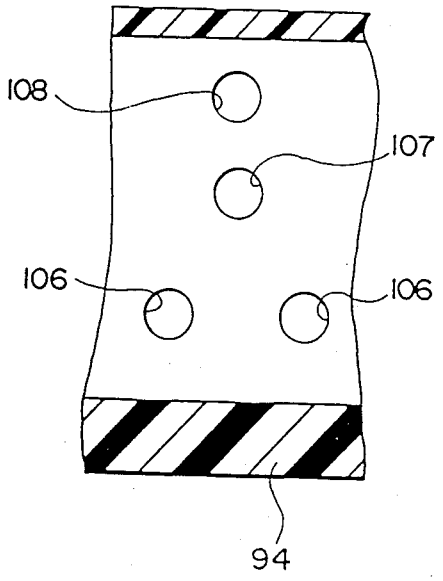
FIG. 10 is a sectional view taken along the line X—X shown in FIG. 9.

The developer and squeezing air inlet 100 is communicated with a passage 104 which is defined by a space inside the processing head 54. The passage 104 is communicated with developer supply ports 106, a squeezing air supply port 108, and a rinsing dispersion medium supply port 107, which are all provided in the rear side of the processing head 54. These supply ports 106, 107, and 108 are disposed in the vertical direction so that, as shown in FIGS. 9 and 10, the squeezing air supply port 108 is disposed at the top as the closest of the three to the upper surface of the processing head 54, followed by the rinsing dispersion medium supply port 107 and the developer supply ports 106 in that order. While one each of the squeezing air supply port 108 and the rinsing dispersion medium supply port 107 are provided, two developer supply ports 106 are provided in such a manner that these supply ports 106 are arranged side by side in the lateral direction of the processing head 54 (i.e., in the horizontal direction as viewed in FIG. 10). The developer supply ports 106 are located at positions which are each laterally shifted from a line drawn vertically from the rinsing dispersion medium supply port 107, so that one of the supply ports 106 is located on the left hand side of the supply port 107 in the horizontal direction as viewed in FIG. 10, while the other is located on the right hand side of the same.

The developer and squeezing air outlet 102 is communicated with a passage 110 defined by a space inside the processing head 54. The passage 110 is communicated with a developer and squeezing air discharge port 112 which is provided in the rear side of the processing head 54.

Figure 11:
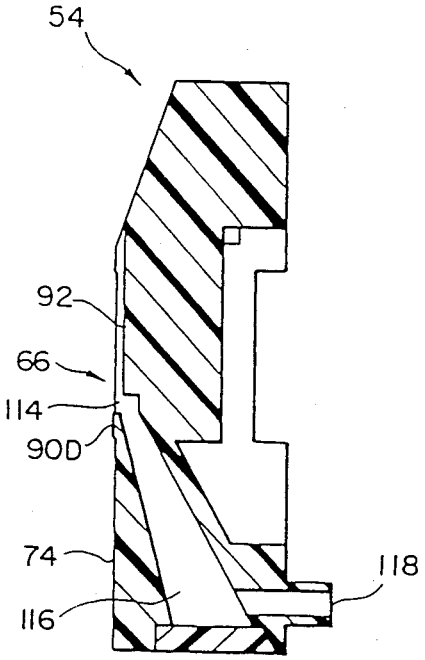
FIG. 11 is a sectional view taken along the line XI—XI shown in FIG. 6.

Recesses 92 are respectively provided on the outer sides of the left and right frame members 90B and 90C of the mask 90. As shown in FIGS. 6 and 11, a squeezing suction port 114 is provided at the lower end of each of the recesses 92. The suction ports 114 are, as shown in FIG. 11, communicated with a passage 116 which is defined by a space inside the processing head 54. The passage 116 is communicated with a suction squeeze opening 118 provided in the rear side of the processing head 54.

Figure 12:
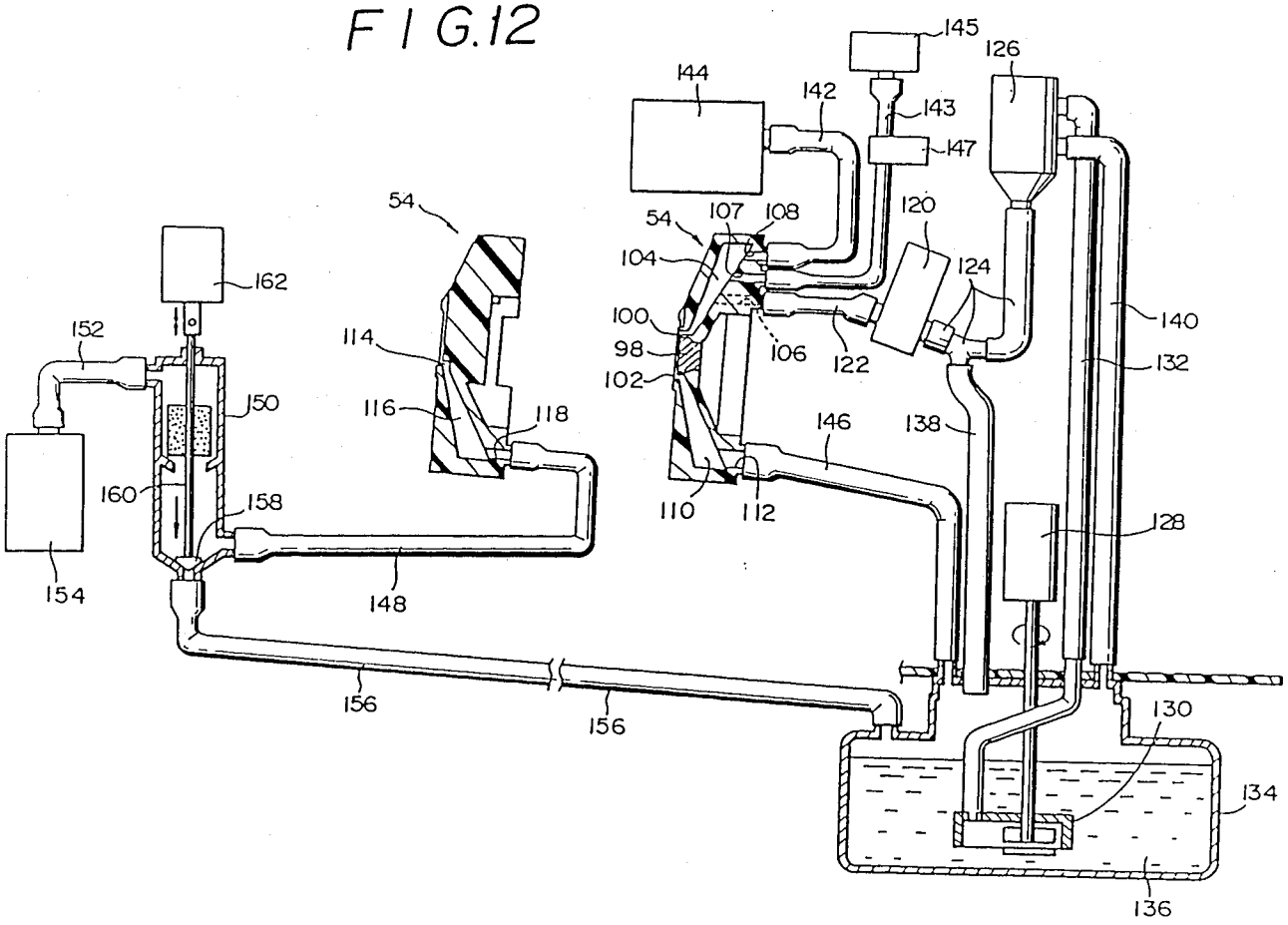
FIG. 12 show the relationship between the developing section in the processing head and its associated devices.

Referring to FIG. 12, the developer supply ports 106 are connected to a developer tank 126 by pipes 122 and 124 through a solenoid valve 120 intermediate between the pipes 122 and 124. The developer tank 126 is positioned above the solenoid valve 120. The developer tank 126 is connected through a pipe 132 to a developer pump 130 activated by a motor 128, the pump 130 being disposed in a developer bottle 134. The developer bottle 134 contains a developer 136 formed by toner particles dispersing in a solvent.

The pipe 124, which connects together the solenoid valve 120 and the developer tank 126, is branched at an intermediate portion tereof to provide a return pipe 138 which opens into the developer bottle 134. In addition, a return pipe 140 which opens into the developer bottle 134 is connected to the developer tank 126.

The squeezing air supply port 108 is connected to a pressure squeezing air pump 144 through a pipe 142. The developer and squeezing air discharge port 112 is connected to a return pipe 146 which opens into the developer bottle 134.

The rinsing dispersion medium supply port 107 is connected to a dispersion medium tank 145 by a pipe 143 through a solenoid valve 147 disposed at an intermediate location of the pipe 143. The dispersion medium tank 145 contains a dispersion medium which is a component of a standard developer, for instance, Isopar (Trade name, a product of Esso).

Therefore, when the solenoid valve 147 opens, the dispersion medium flows under its own weight through the pipe 143 and passes through the rinsing dispersion medium supply port 107 and the passage 104 to be supplied to the developing chamber 98. At this time, since each of the developer supply ports 106 is disposed at a position which is shifted from a line drawn vertically from the rinsing dispersion medium supply port 107, the dispersion medium is kept from entering the developer supply ports 106. An amount of 0.05 g of the dispersion medium is supplied each time, and it is supplied in such a manner that it flows down over the outer surface of the developing electrode 96 after the developer and then the squeezing air have been supplied.

The dispersion medium flows in this way under its own weight to be supplied to the outer surface of the developing electrode 96. This makes it possible to prevent the outer surface of the developing electrode 96 from becoming dry. Even if the outer surface of the electrode 96 does become dry, since solidified developer can be rinsed off the surface concerned, it is possible to reduce the amount of surplus developer which may adhere to and be deposited on the outer surface of the electrode 96. In addition, a small amount of 0.05 g of the dispersion medium is supplied each time, and the dispersion medium is allowed to flow under its own weight from the rinsing dispersion medium supply port 107 through the inner wall of the passage 104 to the outer surface of the developing electrode 96. Therefore, this ensures that the surface of the electrophotographic film 24 which faces the outer surface of the developing electrode 98 is kept from coming into contact with the dispersion medium. By virtue of the supply of the dispersion medium, the outer surface of the electrode 96 can always be kept wet by either the dispersion medium or the developer. Further, the arrangement of the processing head is such that, when developing is suspended for more than 1 minute, the dispersion medium is supplied at intervals of a few minutes.

As shown in FIG. 12, the suction squeeze opening 118 is connected to a suction trap 150 through a pipe 148. The suction trap 150 is in turn connected to a suction squeezing air pump 154 through a pipe 152. A return pipe 156 which opens into the developer bottle 134 is connected to the bottom of the suction trap 150. A valve 158 which is able to close the return pipe 156 is disposed at the joint between the suction trap 150 and the return pipe 156. The valve 158 is moved vertically by the action of a solenoid 162 through a shaft 160.

It should be noted that, as shown in FIG. 12, the processing head 54 is inclined with respect to the horizontal plane so that the optical axis of each of the optical systems is perpendicular to the surface of the screen 16 which is slanted.

Figure 18:
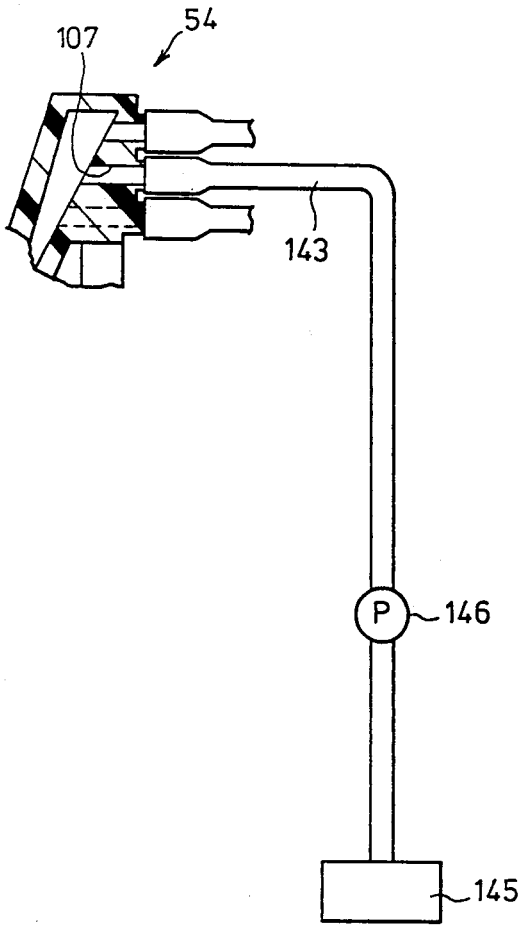
FIG. 18 is a fragmentary view of an example of the processing head in which a rinsing dispersion medium is supplied by means of a pump.

The arrangement for supplying the dispersion medium to processing head 54 may alternatively be such that, as shown in FIG. 18, the dispersion medium is supplied by a pump 146 from the tank 145 through the pipe 143 to the rinsing dispersion medium supply port 107.

Drying Section

Referring to FIGS. 5 and 6, the drying section 68 has a frame 164 which consists of an upper frame member 164A and left and right frame members 1648 and 164C and which has no lower frame member. The left frame member 164B is contiguous with the right-hand end portion of the lower frame member 90D of the mask 90 and rises from the front wall 74 together with the upper frame member 164A. The right frame member 164C rises from a recess 168 which is depressed from the front wall 74 in the shape of a step.

Figure 13:
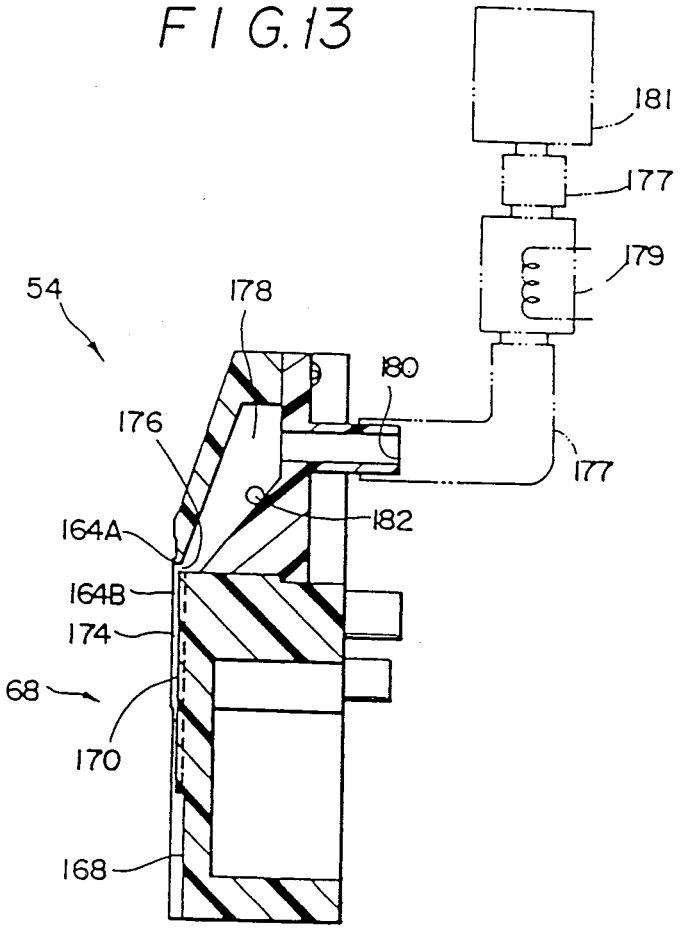
FIG. 13 is a sectional view taken along the line XIII—XIII shown in FIG. 6.

As shown in FIGS. 7 and 13, a wall is formed between the left and right frame members 164B and 164C in such a manner that the surface of the wall 170 is located at a position which is slightly inner than the end face of the frame 164. In addition, recesses 172 are formed on both sides of the wall 170. The bottom surface of each recess 172 is raised from the wall surface of the recess 168 in the front wall 74. The space surrounded by the frame 164, the wall 170, and the recesses 172 defines a drying chamber 174. The distance between the opposing lateral inner surfaces of the frame 164 is set such as to be larger than the width of the opening defined by the mask 90. In addition, the lower surface (the frame inner surface) of the upper frame member 164A is positioned above that of the corresponding member of the mask 90 in the developing section 66.

As shown in FIGS. 6 and 13, the lower portion of the upper frame member 164A is cut in the shape of a slit along the longitudinal direction of the frame member 164A, thereby providing a warm air outlet 176. The warm air outlet 176 is, as shown in FIG. 13, communicated with a passage 178 which is defined by a space inside the processing head 54. The passage 178 is communicated with a warm air supply port 180 which is provided in the rear side of the processing head 54. A temperature sensor 182 is disposed in the passage 178. The warm air supply port 180 is connected to a heater 179 and an air pump 181 through a pipe 177.

Fixing Section

The fixing section 70 is, as shown in FIGS. 5 to 7, defined between the right frame member 164C of the frame 164 and the right-hand end portion of the front wall 74. The fixing section 70 has a frame 184 which consists of a lower frame member and left and right frame members, the frame 184 being located at a position which is further depressed from the recess 168 in the front wall 74. A transparent glass plate 186 is fitted in the frame 184. The space provided on the front side of the glass plate 186 defines a fixing chamber 188.

Figure 14:
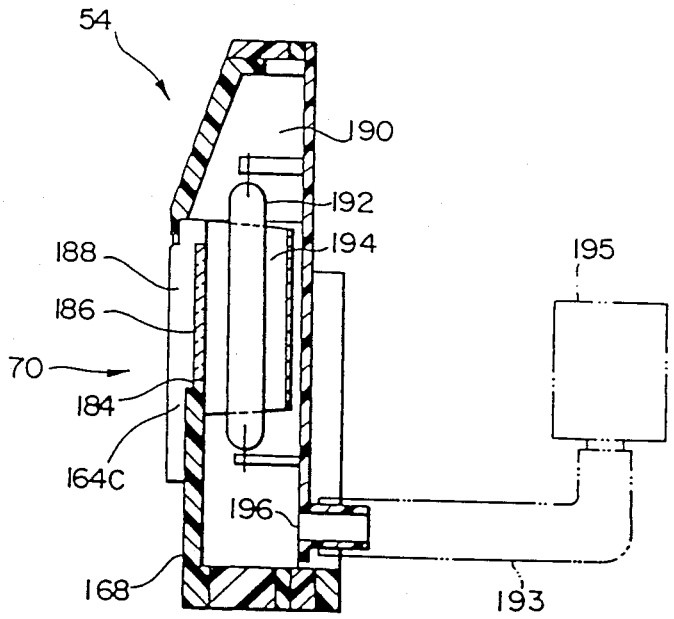
FIG. 14 is a sectional view taken along the line XIV—XIV shown in FIG. 6.

As shown in FIG. 14, a xenon lamp 192 and a reflecting plate 194 are disposed within a space 190 inside the processing head 54 which is provided on the reverse side of the glass plate 186. A cooling air inlet 196 opens into the space 190 so that cold air is supplied to the space 190 from an air pump 195 through a pipe 193. The space 190 and the fixing chamber 188 are communicated with each other through the area defined at the upper edge of the glass plate 186.

Blip Sensor

Referring to FIGS. 5 and 6, the processing head 54 has a blip sensor 196 which is disposed on the left-hand end portion of the front wall 74. The blip sensor 196 is located at a position at which the blip marks 24A printed on the electrophotographic film 24 pass, the film 24 being moved along the front side of the processing head 54. Thus, when each blip mark 24A passes, the blip sensor 196 detects interception of the light from a light source for the sensor 196 which is disposed in opposing relation to the sensor 196 across the film 24.

Film Pressing Mechanism

Figure 15:
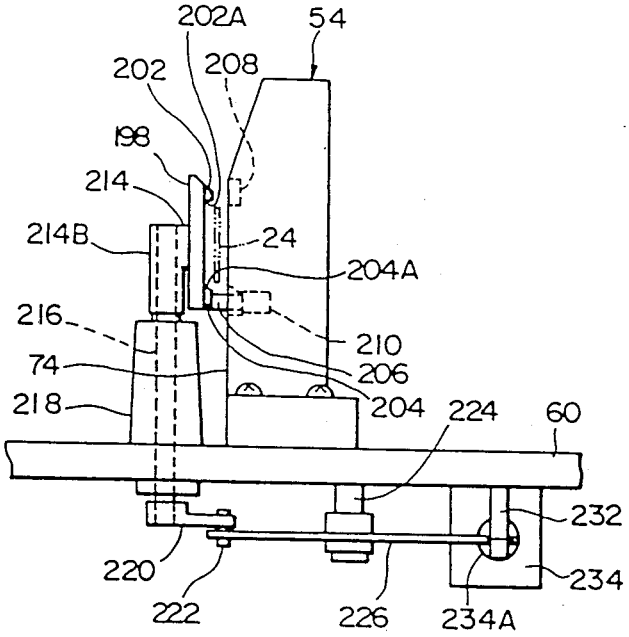
FIG. 15 is a schematic side view showing the positional relationship between the processing head and a pressing plate.

As shown in FIGS. 7 and 15, a pressing plate 198 is disposed in front of the front wall 74 of the processing head 54. The pressing plate 198 is, as shown in FIG. 16, provided with a rectangular through-hole 200 which is of a size smaller than the opening defined by the mask 76 formed in the charging exposure section 64. The pressing plate 198 is disposed in such a manner that the through-hole 200 opposes the mask 76.

Figure 16A:
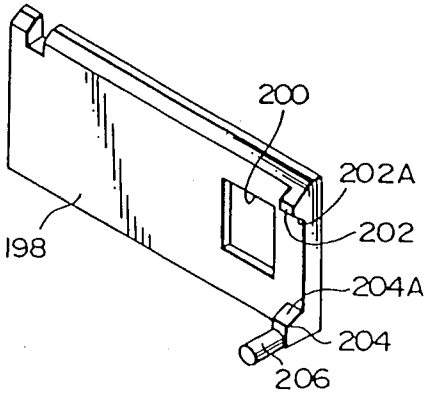
FIG. 16A is a perspective view of one of the elements shown in FIG. 16, as viewed from the opposite side.
Figure 16:
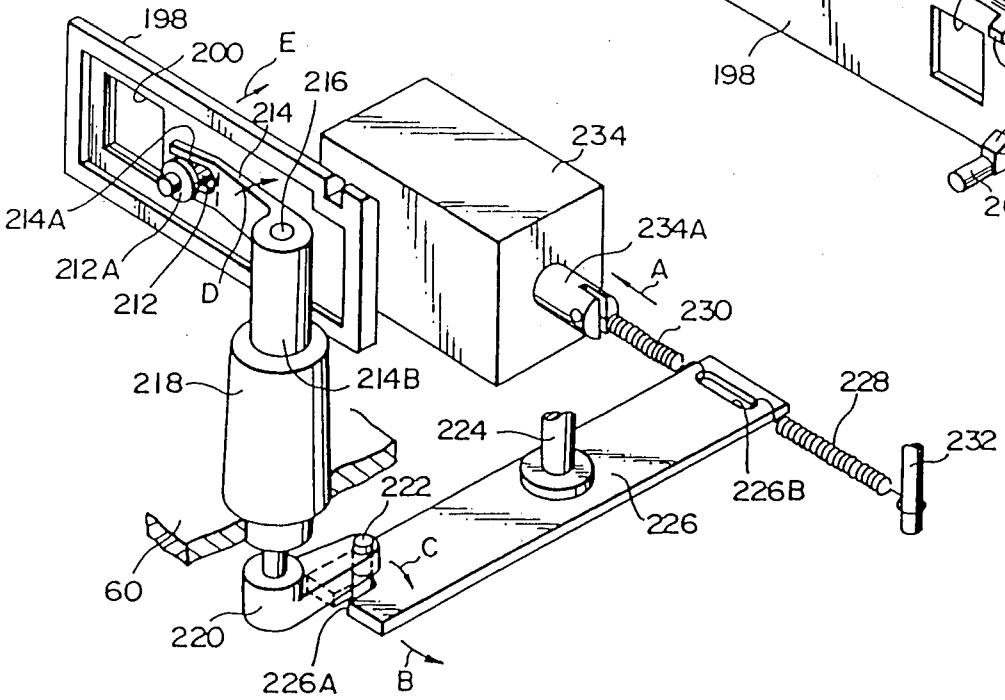
FIG. 16 is a perspective view of a film pressing mechanism disposed on the processing head.

As will be clear from FIG. 16A (a perspective view of the pressing plate 198 shown in FIG. 16, as viewed from the opposite side), the pressing plate 198 has fitting members 202 and 204 respectively formed on the upper and lower end portions on the side of the plate 198 which is closer to the through-hole 200, the fitting members 202 and 204 projecting toward the processing head 54. The opposing inner surfaces of the fitting members 202 and 204 are slanted as at 202A and 204A. The distance between the respective root portions of the upper and lower fitting members 202 and 204 is set such as to be equal to the width of the electrophotographic film 24 (strictly speaking, said distance being slightly larger than the width of the film 24), as shown in FIG. 15. A columnar portion 206 projects from the distal end of the fitting member 204. The fitting members 202 and 204 are able to be fitted into bores 208 and 210, respectively, formed in the front wall 74 of the processing head 54, as shown in FIGS. 5, 6, and 15.

The pressing plate 198 has a columnar portion 212 projecting from the reverse surface thereof, that is, the surface thereof which is remote from the processing head 54. This columnar portion 212 is engaged with a notched portion 214 formed at one end portion of an arm 214. A stop ring 212A is rigidly secured to the distal end portion of the columnar portion 212 so as to prevent the notched portion 214A from coming off th columnar portion 212. A boss portion 214B is formed at the other end of the arm 214. A shaft 216 is rigidly secured to the boss portion 214B.

The shaft 216 is rotatably fitted into and thereby supported by a stand 218 projecting from the frame 60 to which the processing head 54 is secured, the lower end portion of the shaft 216 projecting from the reverse surface of the frame 60. A first lever 20 is rigidly secured to the distal end portion of the shaft 216. A pin 222 is rigidly secured to the distal end portion of the first lever 220.

A shaft 224 is suspended from the reverse side of the frame 60. The shaft 224 pivotally supports an intermediate portion of a second lever 226. A notched portion 226A is formed at one end of the second lever 226, and the pin 222 is engaged with the notched portion 226A. A slot 226B is formed in the other end portion of the second lever 226, and one end portion of each of the tension coil springs 228 and 230 is retained by the slot 226B, the spring 228 and 230 biasing the second lever in the opposite directions to each other so as to support the lever 226 resiliently.

The other end portion of the tension coil spring 228 is retained by a pin 232 suspended from the reverse side of the frame 60, while the other end portion of the tension coil spring 230 is retained by a plunger 234A of a pull-type solenoid 234 which is secured to the reverse side of the frame 60.

When the solenoid 234 is not energized, the pressing plate 198 is separated from the processing head 54. In this state, the pressing plate 198 is supported in such a manner that the columnar portion 206 is fitted into the bore 210, as shown in FIG. 15.

When the solenoid 234 is energized, the plunger 234A is activated to move in the direction of the arrow A, causing the tension coil springs 228 and 230 to be expanded against the biasing forces. In consequence, the second lever 226 is pivoted about the shaft 224 in the direction of the arrow B, so that the first lever 220 is pivoted about the pin 222 in the direction of the arrow C, thus causing the shaft 216 to turn in the same direction. Thus, the arm 214 is pivoted in the direction of the arrow D so as to press the pressing plate 198 in the direction of the arrow E.

The pressing plate 198 is moved in the direction of the arrow E while the columnar portion 206 is being guided by the bore, thus causing the film 24 to be pressed against the end faces of the masks 76, 90 and the frame 164. When the heightwise position of the film 24 is misaligned, the respective slanted surface of the fitting members 202 and 204 act so as to push down the upper edge of the film 24 or push up the lower edge thereof as the pressing plate 198 is moved in the direction of the arrow E.

When the pressing plate 198 is pressing the film 24 against the processing head 54, the fitting members 202 and 204 are respectively fitted in the bores 208 and 210, so that the film 24 is accurately positioned with respect to the processing head 54. In this state, the pressing plate 198 is allowed to resiliently press the film 24 by the action of the tension coil springs 228 and 230.

When the solenoid 234 is de-energized, the second lever 226, which is subjected to the biasing force from the spring 228, is pivoted counter to the direction of the arrow B. In consequence, the arm 214 is pivoted counter to the direction of the arrow D, so that the notched portion 214A presses the stop ring 212A, causing the pressing plate 198 to move counter to the direction of the arrow E.

The following is a description of the operation of this embodiment.

The electrophotographic apparatus is arranged such that, when the power supply switch is turned ON, the cassette loading section 26 (shown in FIG. 1) is raised, thereby allowing a cassette accommodating the electrophotographic film 24 to be loaded into the section 26. After the cassette has been loaded into the cassette loading section 26, the operator pushes down the section 26 to the initial position by a manual operation. In consequence, the cassette loading section 26 is locked at said position. In this state, the film 24 is positioned as shown in FIG. 15 and is allowed to move along the front side of the processing head by the operation of the film moving motor (not shown).

When the image of the document 34 (shown in FIG. 2) is to be recorded on the film 24, the film moving motor is activated to move the film 24 in such a manner that a given frame which is selected from the unexposed frames as desired is positioned in front of the mask 76. This operation is executed by designating a desired frame through the control keyboard 28 shown in FIG. 1. The positioning of the selected frame with respect to the charging exposure section 64 is effected by virtue of the blip sensor 196 which counts the number of blip marks 24A from a reference point.

FIG. 17 is a time chart showing the operation of the apparatus in the case where a given frame is positioned as described above and subjected to recording, and subsequently, continuous recording is effected on each of the frames which consecutively follow the first recorded frame. In the processing head 54, when the frame positioned at the charging exposure section 64 is being subjected to charging and exposure operations, frames which are respectively positioned at the developing section 66, the drying section 68 and the fixing section 70 are simultaneously subjected to different kinds of processing, respectively. However, the following description will be made about only one frame which is to be subjected to recording when the recording button is pressed at the position (I) shown in FIG. 17 to start recording.

Recording of the document 34 is made possible by selecting the camera mode through the control keyboard 28. Simultaneously with this mode selecting operation, a bias voltage is applied to the developing electrode 96 in the developing section 66, the heater 179 for heating air sent to the drying chamber 174 is energized so as to generate heat, and a capacitor for the xenon lamp 192 in the fixing section 70 is supplied with current so as to be charged. These operations are continued while the camera mode is being selected.

When the recording button on the control keyboard 28 is pressed, a high voltage is applied to the corona wire 84 in the charging exposure section 64, causing a corona discharge to occur between the corona wire 84 on one hand and the proximity and mask electrodes 80 and 82 on the other. Thus, the surface of the photosensitive layer of a portion of the film 24 which is positioned within the opening defined by the mask 76 is charged negative.

At the time when the recording button is pressed, the solenoid 234 in the film pressing mechanism has continuously been excited from the previous step. Therefore, the film 24 is pressed by the pressing plate 198 so as to be in pressure contact with the respective end faces of the masks 76, 90 and the frame 164 of the processing head 54. The pressing plate 198 has the through-hole 200 formed in a portion thereof which opposes the mask 76, but this through-hole 200 is smaller than the opening defined by the mask 76. Therefore, a portion of the film 24 which is positioned at the end face of the mask 76 is reliably brought into close contact with the end face of the mask, and the charging range is thereby accurately limited within the opening in the mask 76.

Since the mask electrode 82 provided in the charging exposure chamber 72 is maintained at a potential substantially equal to the potential of the charged film 24, the peripheral edge portion of a frame of the film 24 which is positioned at the opening in the mask 76 is also charged at a value close to the potential at the central portion of said frame, thus enabling the whole of a frame of the film 24 to be uniformly charged. The mask electrode 82 can be maintained at a potential substantially equal to the potential of the charged film 24 by appropriately selecting the value of a resistor (not shown) electrically connected between the ground and the mask electrode 82, or by applying a bias voltage to the mask electrode 82 from an external power supply (not shown).

The document illuminating lamp 36 is turned ON when a predetermined period of time has elapsed after the recording button has been pressed at the position (I) shown in FIG. 17, so as to illuminate the document 34 placed on the glass plate 22 of the document table 18. Further, when a predetermined period of time has elapsed after the recording button has been pressed, the supply of current to the corona wire 84 is suspended, thus completing the corona discharge operation.

At the same time as the suspension of the energization of the corona wire 84, the shutter (not shown but indicated by the reference symbol A in FIG. 17) is opened, and the light reflected from the document 34 placed on the document table 18 is applied to the film 24 by the optical system shown in FIG. 2. In addition, the automatic exposure controller (not shown but indicated by the reference symbol B in FIG. 17) simultaneously starts integration of the quantity of light.

On the other hand, when a predetermined period of time has elapsed after the recording button has been pressed, the motor 128 shown in FIG. 12 is activated to start the operation of the developer pump 130, whereby the developer 136 in the developer bottle 134 is pumped up into the developer tank 126. The developer 136 in the tank 126 gravitationally lowers and passes through the pipe 124 toward the processing head 54. However, since the solenoid valve 120 has not yet been opened at that time, the developer 136 is returned to the developer bottle 134 through the return pipe 138. When the level of the developer 136 in the tank 136 rises, the developer 136 is returned to the developer bottle 134 through the return pipe 140.

In this way, until the solenoid valve 120 is opened, the developer 136 circulats between the developer bottle 134 and the developer tank 126, and while doing so, the developer 136 stands by at a position immediately before the solenoid valve 120. This circulation causes the developer 136 in the developer bottle 134 to be stirred.

When the integrated value of the quantity of light reaches a set value, the integration effected by the automatic exposure controller (B) is suspended and, at the same time, the shutter (A) is closed, and the document illuminating lamp 36 is turned OFF. At this point of time, the exposure step is completed, and one frame of the film 24 in a portion thereof which is positioned at the opening defined by the mask 76 has an electrostatic latent image formed thereon owing to the fact that the electric charge on the photosensitive layer is reduced in accordance with the image pattern on the document 34. Since factors in changes of the image density, such as variations in the ground density of the document 34 and variations in the voltage applied to the document illuminating lamp 36, are corrected by the automatic exposure controller (B), an optimal exposure operation is effected at all times.

When a predetermined period of time has elapsed after the pressing of the recording button and when all the steps of processing other frames have already been completed, the solenoid 234 of the film pressing mechanism is immediately de-energized. When the solenoid 234 is de-energized at the position (IA) shown in FIG. 17, the pressing plate 198 is separated from the film 24.

At the same time as the solenoid 234 of the film pressing mechanism is de-energized, the solenoid 162 of the suction trap 150 shown in FIG. 12 is energized to raise the valve 158 through the shaft 160, thus allowing the return pipe 156 to be communicated with the suction trap 150. In consequence, the developer 136 which has been trapped by the suction trap 150 during the previous developing and squeezing step (described later) is returned to the developer bottle 134.

When a predetermined period of time has elapsed after the solenoid 234 of the film pressing mechanism has been de-energized, the film moving motor (not shown but indicated by the reference symbol C in FIG. 17) is activated to move the film 24 rightwardly as viewed in FIG. 6 by a distance corresponding to one frame. Thus, the frame which has been positioned at the charging exposure section 64 is moved to the developing section 66. The movement of the film 24 by one frame is controlled by the blip sensor 196 in a manner similar to that described above. More specifically, the movement of the film 24 is suspended when the sensor 196 detects a subsequent blip mark 24A.

When a predetermined period of time has elapsed after the film moving motor (C) has been suspended, the solenoid 234 of the film pressing mechanism is energized at the position (IB) shown in FIG. 17, so that the film 2 is pressed against the processing head 54 by the pressing plate 198. At the same time, the solenoid 162 of the suction trap 150 is de-energized so as to close the return pipe 165, and the suction squeezing air pump 154 is activated. In addition, the solenoid valve 120 is opened.

When the solenoid valve 120 is opened, the developer 136 is allowed to reach the processing head 54 through the pipe 122, and the developer 136 then flows into the developing chamber 98 from the developer and squeezing air inlet 100 in the developing section 66. Since the toner particles dispersed in the developer 136 are charged positive, the toner particles, when flowing down through the developing chamber 98, adhere to portions of the film 24 which are charged negative, thereby developing the electrostatic latent image. An amount of 0.3 to 1 cc of the developer 136 is supplied each time when the film 24 has an image size of 10 m×10 m. The developer 136 having flowed down through the developing chamber 98 is returned to the developer bottle 134 from the developer and squeezing air outlet 102 through the return pipe 146.

The diameter or the like of each of the pipes is set so that a part of the developer 136 supplied to the pipe 124 from the developer tank 126 is returned to the developer bottle 134 through the return pipe 138, and the remaining developer 136 advances toward the solenoid valve 120.

Since the film 24 is pressed against the end face of the mask 90 by virtue of the pressing plate 198, substantially no developer 136 enters the gap between the end face of the mask 90 and the film 24 when the developer 136 flows down through the developing chamber 98. Any developer 136 which enters said gap is sucked and trapped into the suction trap 150 from the squeeze suction port 114 through the pipe 148 by means of a vacuum produced in each of the recesses 92 which are respectively located on the outer sides of the left and right frame members 90B and 90C of the mask 90, the vacuum being produced by the action of the suction squeezing air pump 154.

When a predetermined period of time has elapsed after the solenoid 234 of the film pressing mechanism has been energized, the drive of the motor 128 is suspended, and the operation of the developer pump 130 is consequently suspended. However, the solenoid valve 120 remains opened thereafter. Since the developer 136 is gravitationally supplied from the developer tank 126 to the processing head 54, even when the operation of the developer pump 130 is suspended, the supply of the developer 136 to the developing chamber 98 is continued. It is therefore possible to minimize possible exposure blur which may be caused by vibrations of the developer pump 130 during the exposure of a subsequent frame.

When a predetermined period of time has elapsed after the solenoid valve 120 has been opened, the valve 120 is closed to suspend the supply of the developer 136 to the developing chamber 98. At the same time, the pressure squeezing air pump 144 shown in FIG. 12 is activated to supply pressurized air to the developing chamber 98 from the developer and squeezing air inlet 100, whereby surplus developer 136 attached to the film 24 is blown off so as to be swished off. The developer 136 thus blown off is returned to the developer bottle 134 from the developer and squeezing air outlet 102 through the return pipe 146.

The supply of the pressurized air to the developing chamber 98 is controlled in such a manner that a relatively weak blast is applied while a relatively large amount of developer 136 remains in the developing chamber 98 in order to prevent deterioration of the quality of the image which would otherwise be caused by an operation of blowing off the developer 136 at high speed. When a predetermined period of time has elapsed after the application of the blast has been started, a relatively strong blast is applied to increase the squeezing efficiency.

The application of the blast is controlled by the charging exposure step for a subsequent frame which has been started in response to the pressing of the recording button at the position (II) shown in FIG. 17. The application of the blast is suspended at the same time as the drive of the film moving motor (C) is started at the time when a predetermined period of time has elapsed after the solenoid 234 of the film pressing mechanism has been de-energized at the position (IIA) shown in FIG. 17, thus completing the developing and squeezing step.

When the developing and squeezing step has thus been completed, the solenoid valve 147 is opened at the position (IA) shown in FIG. 17. In consequence, the dispersion medium in the dispersion medium tank 145 is allowed to flow therefrom through the pipe 143 under its own weight, and it is supplied to the developing chamber 98 from the rinsing dispersion medium supply port 107. As stated before, the flow of the thus supplied dispersion medium over the surface of the developing electrode 98 prevents said surface from becoming dry, and enables the reduction in the amount of any surplus developer which may adhere to the surface of the electrode and be deposited thereon. Accordingly, it is possible to avoid the risk that surplus developer may adhere to and be deposited on the surface of the developing electrode 96 to present an obstacle to the flow of the developer. Thus, it is ensured that the flow of the developer is uniform.

It should be noted that the presence of the developing electrode 96 during the developing operation enables obtaining of an image having no edge effect. In addition, the application of a bias voltage to the developing electrode 96 prevents fogging of the image.

When the drive of the film moving motor (C) is suspended, the film 24 has been moved righwardly as viewed in FIG. 6 by a distance corresponding to one frame, so that the frame which has been positioned at the developing section 66 is now positioned at the drying section 68. When a predetermined period of time has elapsed after the suspension of the drive of the film moving motor (C), the solenoid 234 of the film pressing mechanism is energized at the position (IIB) shown in FIG. 17 and, at the same time, the air pump 181 shown in FIG. 13 is activated. In consequence, the air heated by the heater 179 is blown into the drying chamber 174 from the warm air outlet 176 in the drying section 68, and the developer 136 is thereby dried. The operation of the air pump 181 is controlled by the charging exposure step for another frame which is started when the recording button is pressed at the position (III) shown in FIG. 17, and is suspended at the same time as the solenoid 234 of the film pressing mechanism is de-energized at the position (IIIA) shown in FIG. 17, thus completing the drying step.

The temperature of the warm air which is supplied to the drying chamber 174 is detected by the temperature sensor 182, and when the temperature is out of a predetermined range, this fact is displayed on the control keyboard 28. When the temperature of the warm air is excessively high, the supply of current to the heater 179 is immediately suspended.

Although in the above-described embodiment the drying air pump 181 is activated in response to the energization of the solenoid 234 of the film pressing mechanism and only when the film 24 is being pressed against the processing head 54, the air pump 181 may alternatively be operated at all times from the start of the operation of the apparatus.

After the solenoid 234 of the film pressing mechanism has been de-energized at the position (IIIA) shown in FIG. 17, the film moving motor (C) is activated, and the frame which has been positioned at the drying section 68 is thereby moved to the fixing section 70. After the drive of the film moving motor (C) has been suspended, the solenoid 234 of the film pressing mechanism is energized at the position (IIIB) shown in FIG. 17 and, at the same time, the air pump 195 shown in FIG. 14 is activated to supply cold air to the space 190 in the fixing section 70. The cold air supplied to the space 190 passes through the area defined at the upper edge of the glass plate 186 to reach the fixing chamber 188.

When a predetermined period of time has elapsed after the solenoid 234 of the film pressing mechanism has been energized, the xenon lamp 192 is turned ON, so that the toner particles are fused and fixed to the surface of the film 24, thus completing the fixing step.

Any matter which is vaporized or scattered during the fixing operation is blown off by means of the cold air supplied from the air pump 195, and there is no fear of such manner adhering to the surface of the glass plate 186.

When the above-described steps are finished, the recording of an image on the electrophotographic film 24 is completed.

In the apparatus according to this embodiment, when the recording button is pressed, recording is started, and after the recorded frame positioned at the charging exposure section 64 has been moved to the developing section 66 and when a predetermined period of time has elapsed after the solenoid 234 of the film pressing mechanism has been energized, it becomes possible to record a subsequent frame. To effect continuous recording of following consecutive frames, the recording button is pressed during the period which begins when it becomes possible to record a subsequent frame and which ends when a predetermined period of time has elapsed after the completion of the application of a relatively weak blast to the developing section 66 by the pressure squeezing air pump 144. In consequence, the recording step is repeated, and the processing proceeds as shown in FIG. 17.

When the recording button is not pressed during said period, or when the command to end a series of recording operations is input from the control keyboard 28, the application of a relatively strong blast by the air pump 144 is suspended in accordance with the operation of a timer, and the drying and fixing operations carried out thereafter are also executed in accordance with the timer.

When the reader mode is selected, it is possible to project the film 24 having images of documents recorded thereon as described above. The electrophotographic apparatus in accordance with this embodiment is arranged such that, when a cassette is loaded in the same way as described above, the reader mode is automatically selected (the third mirror 38 has already been moved from the position shown in FIG. 2 to another position). When a given frame is moved to and stopped at the charging exposure section 64 by an operation similar to that described above, the light source of the projecting light source section 46 shown in FIG. 3 is turned ON. The light from the light source is passed through the through-hole 200 provided in the pressing plate 198 and transmitted by the film 24, and the image recorded on the film 24 is enlarged and projected on the screen 16 by the optical system shown in FIG. 3.

At the same time as the light source is turned ON, the air pump 89 shown in FIG. 7 is activated to supply cold air to the charging exposure chamber 72 so as to cool the film 24, thereby preventing the film 24 from being heated to high temperature by the heat from the projecting light source section 46, and thus avoiding any out-of-focus problem due to thermal deformation of the film 24.

In the reader mode, it is possible to continuously view projected images of the film 24 within a short period of time by successively advancing the film 24 for each frame through the control keyboard 28. In such a case, every time the film 24 is moved, the shutter (A) is closed in order to prevent flickering due to persistence phenomenon.

When the copy button on the control keyboard 28 is pressed while an image is being projected on the screen 16, the copy mode is selected. In consequence, the copy mirror 52 is moved, and the image being projected on the screen 16 is recorded on a sheet of copying paper 30 by the optical system shown in FIG.4.

As described above, the processing head for an electrophotographic apparatus in accordance with the present invention is capable of supplying a rinsing liquid to the developing section by rinsing liquid supply means after the completion of the developing. Therefore, it is possible to reduce the amount of any surplus developer which may adhere to the developing electrode and may be deposited thereon to present an obstacle to the flow of the developer, and it is thereby ensured that the flow of the developer is uniform.

What is claimed is:

1. A processing head for an electrophotographic apparatus which is adapted at least to develop by means of a liquid developer an image formed on an electrophotographic film by subjecting said film to charging and exposure to light, said processing head comprising:

a developing section to which said liquid developer is supplied for the developing of said image; and rinsing liquid supply means for applying a rinsing liquid to said developing section after the completion of said developing, wherein said rinsing liquid supply means comprises a container which contains said rinsing liquid and a first passage communicating said container with said developing section, and a valve for opening and closing said first passage.

2. A processing head for an electrophotographic apparatus which is adapted at least to develop by means of a liquid developer an image formed on an electrophotographic film by subjecting said film to charging and exposure to light, said processing head comprising:

a developing section to which said liquid developer is supplied for the developing of said image; and rinsing liquid supply means for supplying a rinsing liquid to said developing section after the completion of said developing, and wherein said rinsing liquid supply means comprises a container which contains said rinsing liquid and a first passage communicating said container with said developing section is defined by a developing electrode having a planar surface and a frame which is disposed around said developing electrode in such a manner as to project from said surface of said electrode, and said processing head being disposed at an angle at which said liquid developer and said rinsing liquid are able to flow down over said surface of said electrode under the weight thereof.

3. A processing head for an electrophotographic apparatus according to claim 2, further comprising a first opening provided at a location which is between said developing electrode and said frame and which is upstream in the direction in which said liquid developer and said rinsing liquid flow under the weight thereof, said liquid developer and said rinsing liquid being supplied to said developing section through said first opening.

4. A processing head for an electrophotographic apparatus according to claim 3, further comprising a space formed therein, said first space communicating said opening with said first passage and also with a second passage for supplying said liquid developer to said developing section.

5. A processing head for an electrophotographic apparatus according to claim 4, where in said space has an inclined surface which is inclined such that said liquid developer and said rinsing liquid reach said opening under the weight thereof.

6. A processing head for an electrophotographic apparatus according to claim 5, wherein a second opening communicates said space with said first passage and a third opening communicates said space with said second passage, and said second and third openings are vertically spaced from each other such that said rinsing liquid and said liquid developer flowing through said space under the weight thereof do not become mixed.

7. A processing head for an electrophotographic apparatus comprising a charging exposure section for charging an electrophotographic film and exposing the thus charged film to light from an image so as to form an image corresponding to said image on said film, a developing section for developing said image thus formed on said film, a drying section for drying said film, and a fixing section for fixing said image on the thus dried film, said processing head further comprising:

liquid developer supply means for supplying a liquid developer to said developing section; and rinsing liquid supply means for supplying a rinsing liquid to said developing section.

8. A processing head for an electrophotographic apparatus according to claim 7, wherein said rinsing liquid supply means comprises a container which contains said rinsing liquid and a first passage communicating said container with said developing section.

9. A processing head for an electrophotographic apparatus according to claim 8, wherein said rinsing liquid supply means further comprises a valve for opening and closing said first passage.

10. A processing head for an electrophotographic apparatus according to claim 8, wherein said rinsing liquid supply means further comprises pump means for delivering said rinsing liquid from said container to said developing section through said first passage.

11. A processing head for an electrophotographic apparatus according to claim 8, wherein said developing section is defined by a developing electrode having a planar surface and a frame which is disposed around said developing electrode in such a manner as to project from said surface of said electrode, said processing head being disposed at an angle at which said liquid developer and said rinsing liquid are able to flow down over said surface of said electrode under the weight thereof.

12. A processing head for an electrophotographic apparatus according to claim 11, further comprising a first opening provided at a location which is between said developing electrode and said frame and which is upstream in the direction in which said liquid developer and said rinsing liquid flow under the weight thereof, said liquid developer and said rinsing liquid being supplied to said developing section through said first opening.

13. A processing head for an electrophotographic apparatus according to claim 12, further comprising a space formed therein, said space communicating said opening with said first passage and also with a second passage for supplying said liquid developer to said developing section.

14. A processing head for an electrophotographic apparatus according to claim 13, wherein said space has an inclined surface which is inclined such that said liquid developer and said rinsing liquid reach said opening under the weight thereof.

15. A processing head for an electrophotographic apparatus according to claim 14, wherein a second opening communicates said space with said first passage and a third opening communicates said space with said second passage, and said second and third openings are vertically spaced from each other such that said rinsing liquid and said liquid developer flowing through said space under the weight thereof do not become mixed.

* * * * *